US011091362B2

(12) United States Patent
Grause, Jr.

(10) Patent No.: US 11,091,362 B2
(45) Date of Patent: Aug. 17, 2021

(54) GRAVITY FED VISCOUS LIQUID AND FOOD PRODUCT DISPENSING SYSTEM

(71) Applicant: Grabas Limited, Hebron, KY (US)

(72) Inventor: Michael J. Grause, Jr., Hebron, KY (US)

(73) Assignee: Grabas Limited, Hebron, KY (US)

( * ) Notice: Subject to any disclaimer, the term of this patent is extended or adjusted under 35 U.S.C. 154(b) by 0 days.

(21) Appl. No.: 16/718,824

(22) Filed: Dec. 18, 2019

(65) Prior Publication Data

US 2020/0122997 A1 Apr. 23, 2020

Related U.S. Application Data

(63) Continuation of application No. 15/975,248, filed on May 9, 2018, now Pat. No. 10,526,189.

(60) Provisional application No. 62/504,686, filed on May 11, 2017.

(51) Int. Cl.

| | |
|---|---|
| ***B67D 3/00*** | (2006.01) |
| ***A47K 5/12*** | (2006.01) |
| ***B67D 3/04*** | (2006.01) |
| ***B65D 77/06*** | (2006.01) |

(52) U.S. Cl.

CPC ..... *B67D 3/0032* (2013.01); *A47K 5/1214* (2013.01); *B65D 77/067* (2013.01); *B67D 3/00* (2013.01); *B67D 3/0022* (2013.01); *B67D 3/045* (2013.01); *B67D 3/0029* (2013.01); *B67D 3/0067* (2013.01)

(58) Field of Classification Search

CPC ..... B67D 3/0032; B67D 3/00; B67D 3/0022; B67D 3/045; B67D 3/0029; B67D 3/0067; B65D 77/067; A47K 5/1214

See application file for complete search history.

(56) References Cited

U.S. PATENT DOCUMENTS

| | | | | | |
|---|---|---|---|---|---|
| 1,553,113 | A * | 9/1925 | Rutt | A47K 5/1214 | 222/484 |
| 2,831,610 | A * | 4/1958 | Dennie | B65D 5/5059 | 222/105 |
| 4,429,812 | A * | 2/1984 | Steiner | A47K 5/1208 | 141/18 |
| 4,557,399 | A * | 12/1985 | Redick, Jr. | B67B 7/28 | 141/18 |
| 4,848,596 | A * | 7/1989 | Rudick | B67D 3/045 | 222/162 |
| 5,803,317 | A * | 9/1998 | Wheeler | B67D 1/0004 | 222/105 |
| 6,056,157 | A * | 5/2000 | Gehl | B65D 77/06 | 222/105 |

(Continued)

*Primary Examiner* — Donnell A Long

(74) *Attorney, Agent, or Firm* — Ulmer & Berne LLP

(57) ABSTRACT

A liquid and semi-liquid product dispenser that allows for gravity dispensing of product by using a product bottle that slopes downwards towards the feed valve when the bottle is placed for dispensing. This includes a long-sloped portion that extends downwards from the rear of the bottle to the front of the bottle, and a curved and sloped portion proximate to the valve. These slopes feed product to the valve under the force of gravity when the valve is opened. Installation of product bottles is aided by an interior design of the dispenser case that mirrors the bottles contours and ensures that the bottle is positioned for use when placed.

18 Claims, 18 Drawing Sheets

(56) References Cited

U.S. PATENT DOCUMENTS

| | | | | |
|---|---|---|---|---|
| 6,186,361 | B1 * | 2/2001 | Teetsel, III | B67B 7/26 222/1 |
| 9,580,290 | B1 * | 2/2017 | Gallagher | B67D 3/0035 |
| 10,526,189 | B2 | 1/2020 | Grause, Jr. | |
| 2003/0116584 | A1 * | 6/2003 | Gutierrez | B67D 7/80 222/1 |
| 2005/0252937 | A1 * | 11/2005 | Gehl | B67D 3/045 222/518 |
| 2006/0110512 | A1 * | 5/2006 | Blomme | B67D 3/0029 426/523 |
| 2006/0248901 | A1 * | 11/2006 | Flax | B67D 3/0029 62/3.2 |
| 2008/0011660 | A1 * | 1/2008 | Walton | B67D 3/0032 210/209 |
| 2012/0318824 | A1 * | 12/2012 | McKenna | B67D 3/04 222/185.1 |
| 2014/0252031 | A1 * | 9/2014 | Norris | B67D 3/0083 222/105 |

* cited by examiner

GRAVITY FED VISCOUS LIQUID AND FOOD PRODUCT DISPENSING SYSTEM

PRIORITY

This application is a continuation of U.S. patent application Ser. No. 15/975,248, filed May 9, 2018, entitled "Gravity Fed Viscous Liquid and Food Product Dispensing System," which itself claims priority to U.S. Provisional Patent Application No. 62/504,686, filed May 11, 2017, entitled "Gravity Fed Viscous Liquid and Food Product Dispensing System," the disclosure of each which is hereby incorporated by reference in its entirety.

FIELD

The disclosed technology pertains to a gravity fed system for storing and dispensing various viscous liquids and food products.

BACKGROUND

Many conventional liquid and food product dispensing systems rely on a bag-in-box or other bag-based product storage and delivery design. With such systems, a flexible plastic bag is filled with product, such as beverages, liquid or semi liquid foods, liquid soaps or cleaners, or other similar products. This bag is often placed inside a cardboard box or other container to provide for additional protection and immobilization during transport. When the product is needed, the box is either removed and disposed of leaving only the bag, or a section of the bag is pulled through a hole in the box, and then the bag is placed within a dispenser unit. The bag often has a valve or a mounting point for a valve, and once pierced or otherwise opened, this valve may be hooked to a pump of some sort that, when actuated by a user, will draw the food product or liquid out of the bag and through a nozzle of the dispenser. Other bag-in-box systems may instead use a weight, spring mechanism, or other mechanical pressing mechanism to press down upon the bag to force product towards a valve. Bag and bag-in-box packaging is especially common in food related applications, because it allows for product to be packed, stored, and dispensed with minimal or no exposure to bacteria.

This decades old technology has numerous shortcomings, but is still popular due to factors such as low cost, familiarity, ease of disposal, and availability of compatible dispensing systems. One shortcoming is the need for some sort of active system or mechanical device for aiding in dispensing, whether it be a negative or positive displacement pump, a bag compressor or squeezer, a weighted press system, or other system. These systems are necessary because the product in a bag is frequently too viscous to flow from an opening in the bag under its own weight, and the valve on a bag is often mounted at a point above the bottom of the bag. A pump allows for even viscous product to be pulled from the bag, and the flexible bag may compress, shift and shrink during use, so valve position relative to remaining product is not critical as it will, to some extent, be forced into the value as the bag compresses. However even with such systems and in an ideal scenario, the amount of product extracted from a bag might typically be approximately 90% for active systems or 85% for weighted press systems, with the remainder being disposed of. In actual retail environments, due to work pressures and lack of training, bags of product are frequently switched as soon as a customer complains that dispensing is slow, meaning that 25% or more of the product may commonly be disposed of.

In addition to wasted product, ease of handling and installation of bag products is poor. Frequently, a flexible, tear-prone, liquid filled bag must be forced and arranged within a metal rectangular box, which may have sharp edges and may be heated, and is generally at a height that is above waist level on a retail counter top. An installer must avoid tearing the bag, ensure the bag and product are arranged to allow the door to close, avoid cutting or burning themselves on the heated unit's interior, and ensure that the bag's valve is near enough the dispensing nozzle and pump that it can be pushed or pulled into place and attached. Factor in that, in environments where these types of dispenses are commonly found (e.g., gas stations, small food marts, or other convenience stores), the person who must install a new bag is often the only employee on duty, meaning that frustrating and imperfect task must be performed while one or more customers wait. Considering the shortcomings of bag systems, it may be that whatever advantages these systems have as far as being inexpensive are lost as a result of unextracted and wasted product, installation time, and the purchase and maintenance of active pumping systems.

What is needed, therefore, is an improved system for storing and dispensing viscous liquids and other food product.

BRIEF DESCRIPTION OF THE DRAWINGS

The drawings and detailed description that follow are intended to be merely illustrative and are not intended to limit the scope of the invention.

DETAILED DESCRIPTION

The present disclosure describes novel technology that, for the purpose of illustration, is applied in the context of product dispensing systems. While the disclosed applications of the technology satisfy a long-felt but unmet need in the art of product dispensing systems, it should be understood that the technology is not limited to being implemented in the precise manners set forth herein, but could be implemented in other manners without undue experimentation by those of ordinary skill in the art in light of this disclosure. Accordingly, the examples set forth herein should be understood as being illustrative only, and should not be treated as limiting.

Figure 1:
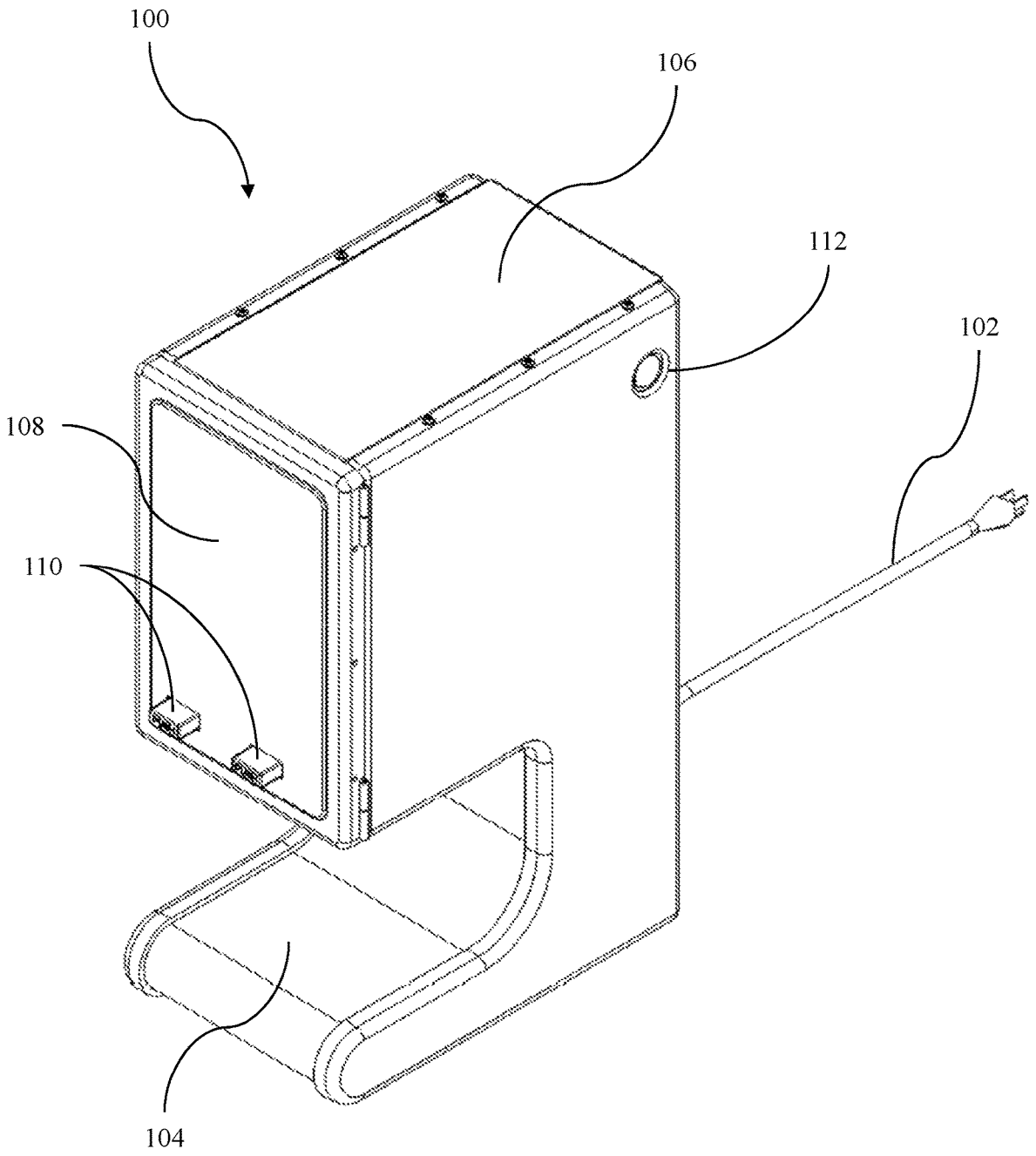
FIG. 1 is a front perspective view of an exemplary product dispensing system.

Turning now to the figures, FIG. 1 shows a front perspective view of an exemplary product dispensing system (100). The product dispensing system (100) has a case (106), which contains a product compartment (105) (FIG. 3), which is enclosed by a door (108), which may be attached to the case (106) by hinges or some other fastening mechanism. The case (106) and door (108) is constructed from metal, plastic, or other similar materials, or combinations of materials, and can be insulated with various materials or air cavities. In one version, the case (106) includes a temperature gauge (112) showing internal temperature of the product compartment (105) in embodiments of this technology that have a heating element or heating function for the product compartment (105). In other versions, the temperature gauge (112) may be omitted entirely. A power source (102) is used to provide power for features such as internal heating elements, lighting, ventilation, and other powered features that various embodiments of the product dispensing system (100) may have. Power source (102) is shown as a standard electric cord, but could also be a battery, power generator, or other power supply.

Figure 2:
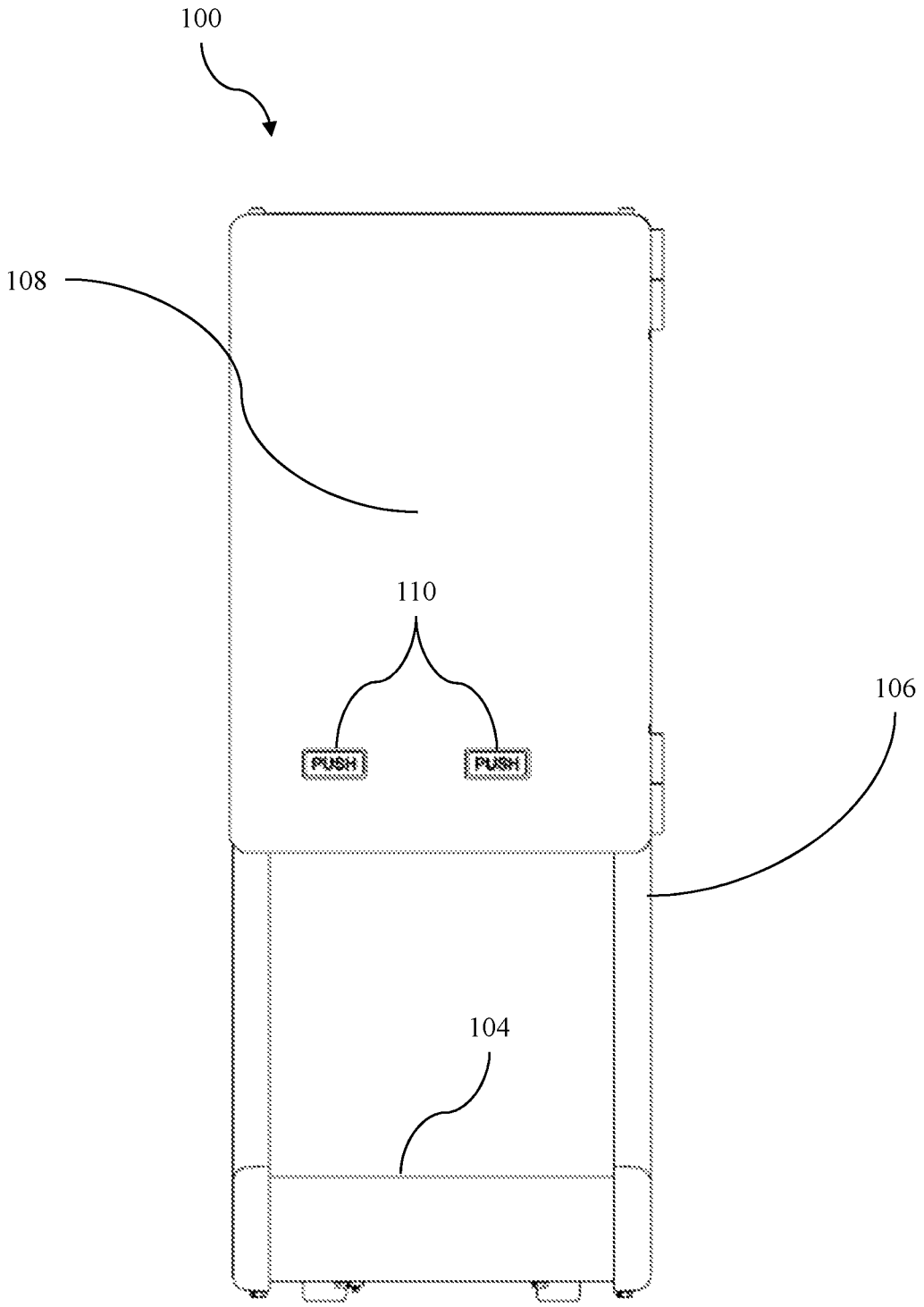
FIG. 2 is a front elevation view of the product dispensing system of FIG. 1.

The product dispensing system (100) has one or more push buttons (110) mounted on the door (108), which may be pushed in order to cause product (301) to dispense from the product compartment (105) onto the product shelf (104) (e.g., into a cup or container placed on the product shelf (104)). FIG. 2 is a front elevation view of the exemplary product dispensing system (100). In the shown example, there are two push buttons (110) which may be pushed by a user to cause a product (301) (FIG. 17) to be dispensed towards the product shelf (104). Each push button (110) may dispense the same product, or each may be dispense a different product, based upon what sort of product container is installed for each push button (110), as will be described and shown below.

Figure 3:
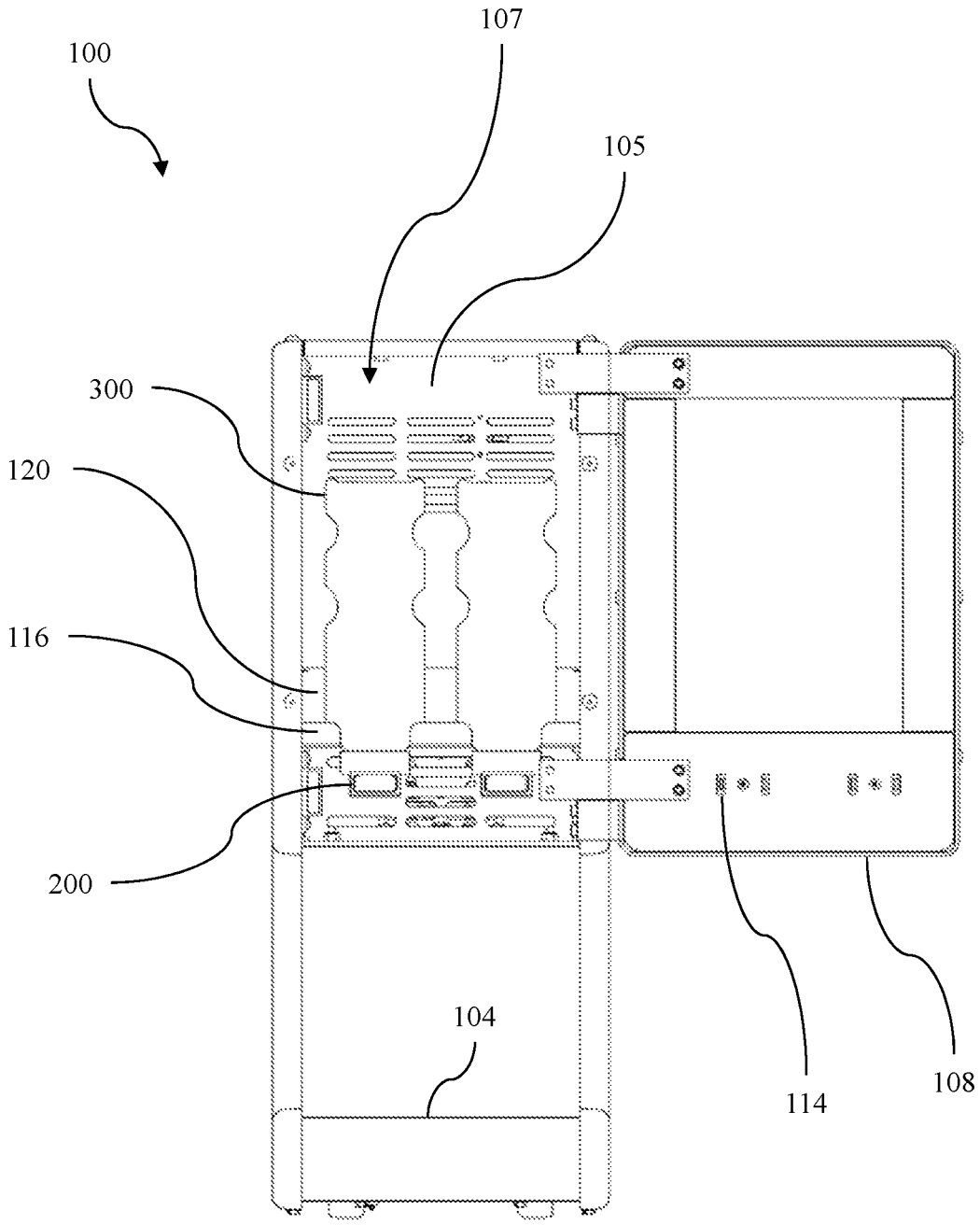
FIG. 3 is a front elevation view of the product dispensing system of FIG. 1, with a door opened to show an interior.

FIG. 3 is a front elevation view of the exemplary product dispensing system (100) with the door (108) opened to show an interior (107). The product compartment (105) is a largely empty space of the interior (107) of the case (106). One or more product bottles (300) can be installed inside the product compartment (105) by placing them on an inclined shelf (120) that includes a surface (121) that slopes upwards from the front of the product dispensing system (100) towards the rear. A positioning shelf (116) at the front of the product dispensing system (100) helps to hold the product bottle (300) in place, and also positions a push valve (200) in the proper location to be activated by the push button (110) when it is pressed. For the purpose of clarity, the term "front" refers to the end of the product dispensing system (100) where the push buttons (110) are located, and the term "rear" refers to the opposite end to the front.

Pressing the push button (110) when the door (108) is closed causes one or more button arms (114) to extend into the interior (107) of the product dispensing system (100) and push against the the push valve (200), causing product to dispense from the product bottle (300) towards the product shelf (104), as will be described in further detail below. The interior walls (123) (FIG. 4) of the case (106), which define the product compartment (105), as well as the inclined shelf (120) and positioning shelf (116) may be made of metal, plastic, or other materials. The interior walls (123) of the case (106) may have holes or vents to allow for the free flow of air throughout the product compartment (105), whether forced or ambient, such that heated air may freely flow around a product bottle (300) placed within the product compartment (105). The combination of the inclined shelf (120) and positioning shelf (116) serve to support and hold the product bottle (300) in place, and while not pictured in the embodiment of FIG. 3, additional brackets, rails, or other stabilizing features may be placed at various heights within the product compartment (105) to provide further stability to installed product bottles (300), as will be apparent to one of ordinary skill in the art in light of this disclosure.

Figure 4:
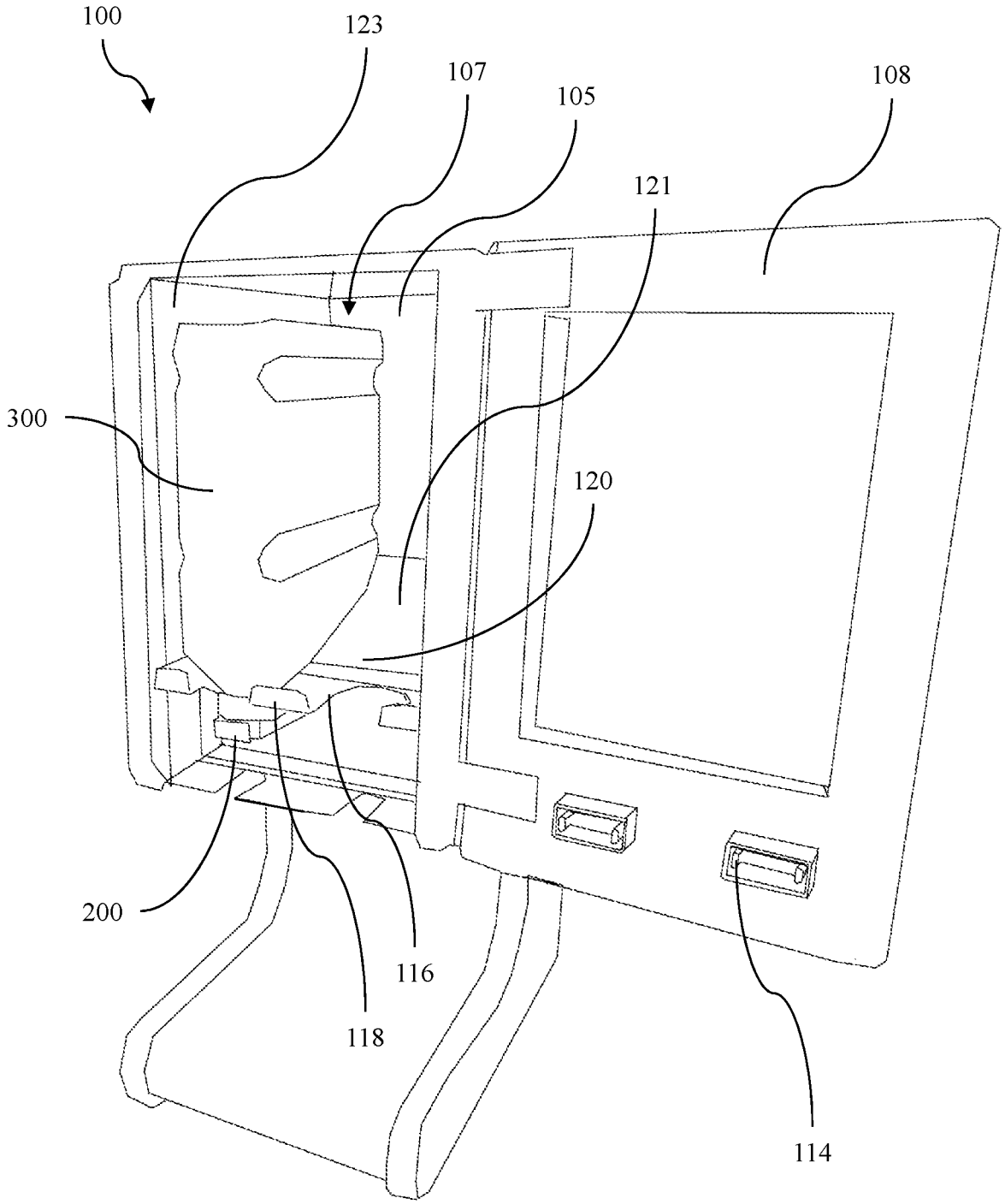
FIG. 4 is a front perspective view of the product dispensing system of FIG. 3.
Figure 5:
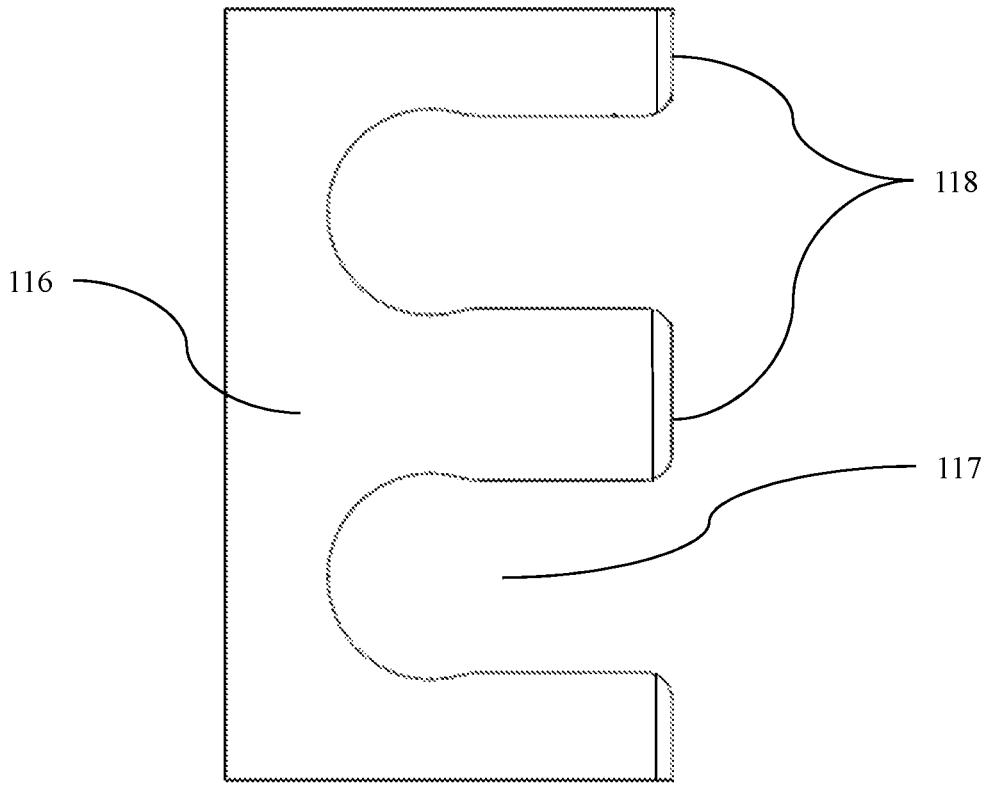
FIG. 5 is an overhead plan view of an exemplary positioning shelf of the product dispensing system of FIG. 1, where the positioning shelf is configured to hold product containers in place.

FIG. 4 is a front perspective view of the exemplary product dispensing system (100) with a door (108) opened to show the interior (107). In the shown embodiment, the slope of the inclined shelf (120) matches the slope of a bottom surface (304) (FIG. 17) of the product bottle (300) so that the bottle (300) rests firmly against the inclined shelf (120). It can also be seen in FIG. 4, as well as FIG. 5, that the positioning shelf (116) has one or more low retaining lips (118) that contact the front of an installed product bottle (300). The retaining lips (118) help to stabilize the product bottle (300) and prevent it from sliding out of the product compartment (105), instead requiring that the product bottle (300) be lifted slightly to clear the retaining shelf (116) when the product bottle (300) is removed.

The positioning shelf (105) also comprises a valve notch (117) that shares the general shape of a neck portion (305) (FIG. 17) of the product bottle (300). This allows for the product bottle (300) with the attached push valve (200) to be passed over the retaining lips (118) of the positioning shelf (116), and then lowered into the positioning shelf (116) so that a portion of the product bottle (300) and the push valve (200) pass below the positioning shelf (116), while the remainder of the product bottle (300) rests upon the outer edge of the valve notch (117) and the inclined shelf (120). These features allow for the product bottle (300) to be quickly and easily installed in the product compartment (105), but also ensure that, once installed, the product bottle (300) and push valve (200) are in the proper location so that the door (108) may be fully closed and the push button (110) will align with and contact the push valve (200) when the push button (110) is pressed. Installation of the product bottle (300) is complete once it is placed on the positioning shelf (120). The above described configuration is unlike conventional bag-in-box systems that require either a bag to be placed and manipulated into the proper position so that hoses or valves can be attached and fed into or connected to a peristaltic pump system, or so that a weight, press, or other press system can be placed or positioned so that it presses on the bag from above to aid in extraction. It should be noted that while the shown product dispensing system (100) is configured to allow for two product bottles (300), the novel features of this system would allow for systems supporting three or more product bottles (300) to be implemented, if so desired. Similarly, other versions of product dispensing systems may be configured for use with a single product bottle (300).

Figure 6:
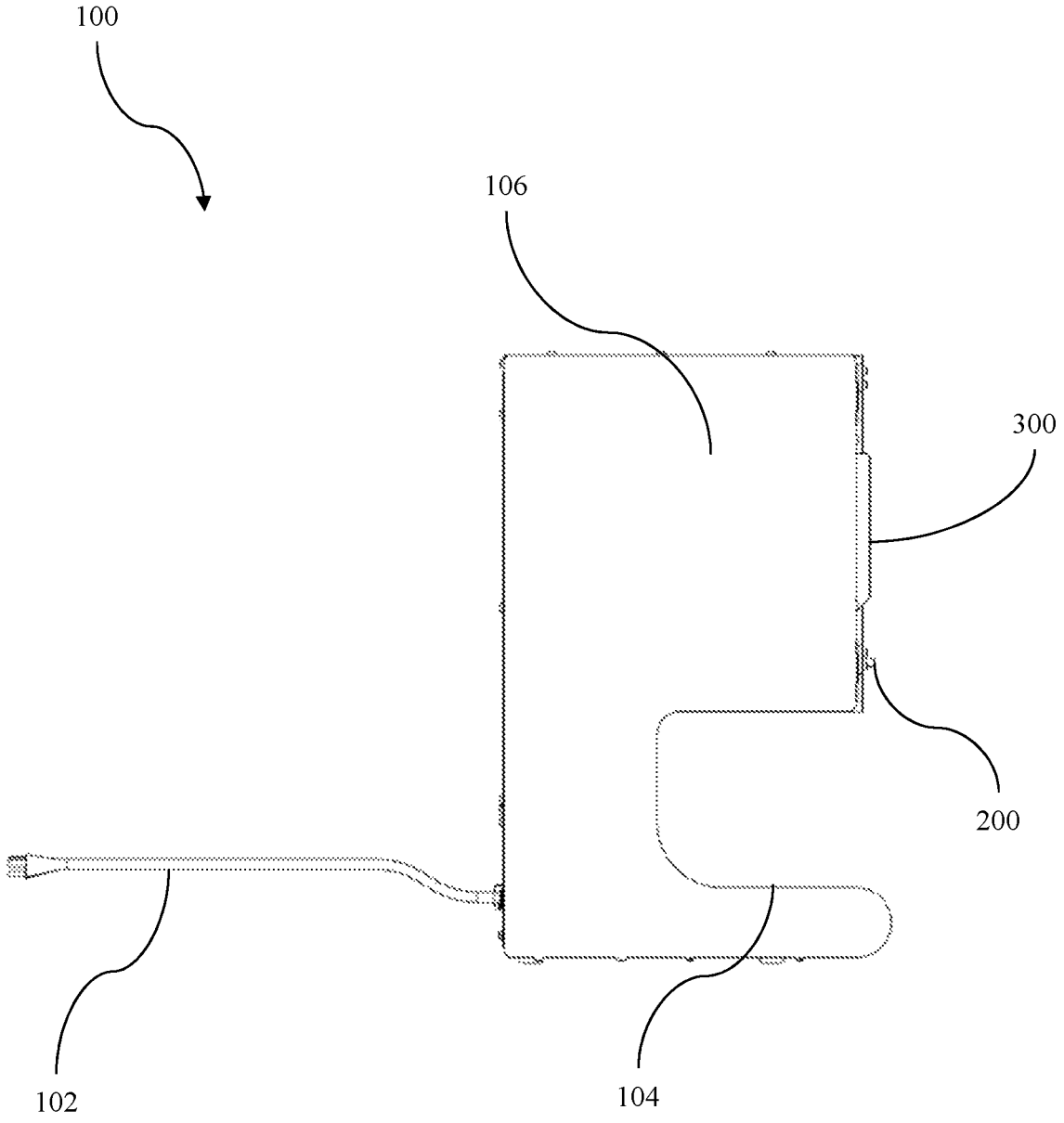
FIG. 6 is a side elevation view of the product dispensing system of FIG. 1.
Figure 7:
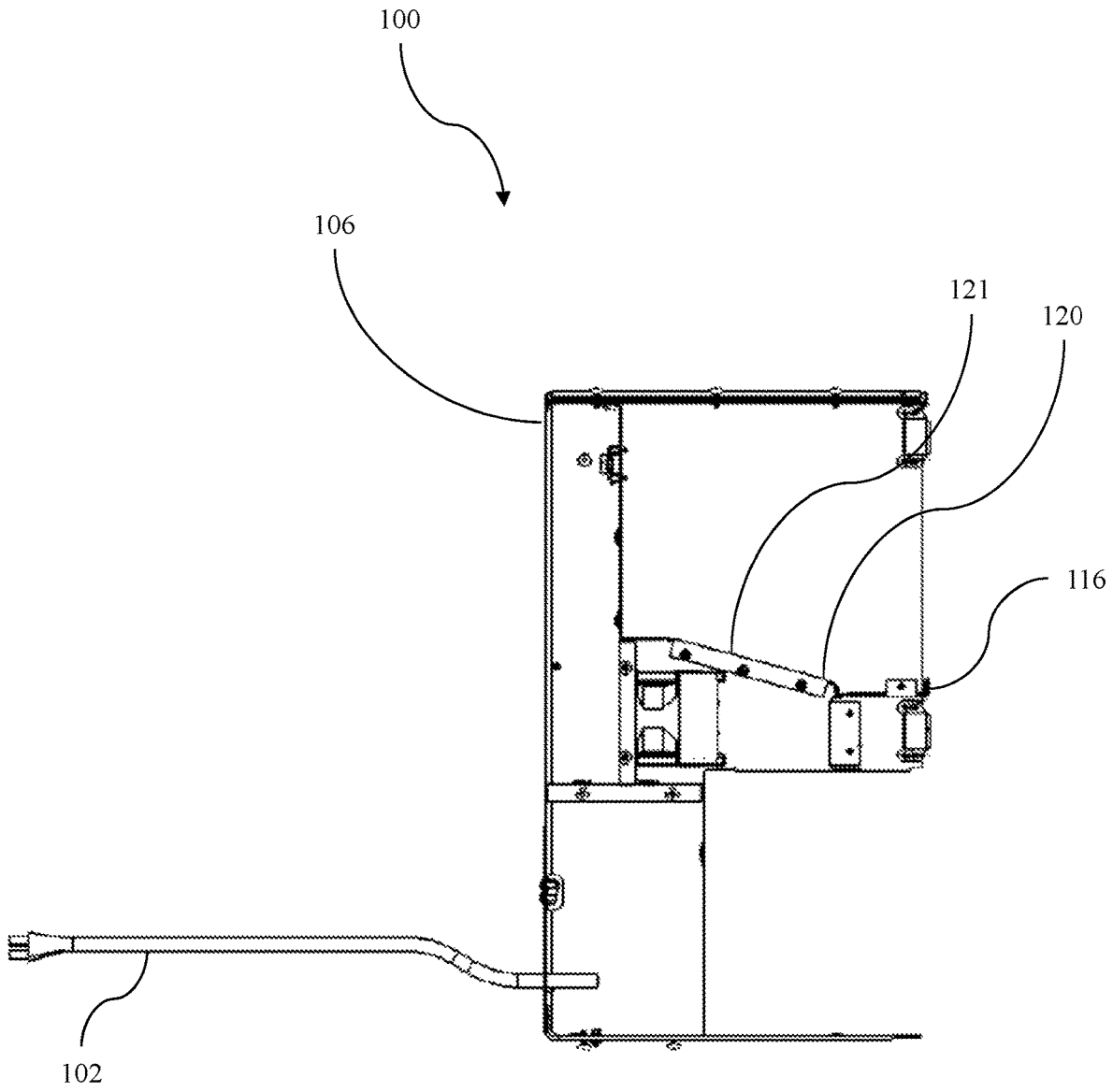
FIG. 7 is a side cross-sectional view of the product dispensing system of FIG. 6.

FIG. 6 is a side elevation view of the exemplary product dispensing system (100), with the door (108) opened or removed. The product bottle (300) and push valve (200) can be seen protruding from within the product compartment (105), showing their approximate position relative to the product shelf (104). FIG. 7 is a side cross-sectional view of the exemplary product dispensing system (100) with no product bottle (300) installed. This view clearly shows the inclined shelf (120) and positioning shelf (116), which together create a resting surface that provides support for the shape of the product bottle (300). The shape of the product bottle (300) allows for gravity to provide the feed mechanism for product passing through the push valve (200) when it is opened, as product in the product bottle (300) will naturally flow down the inclined portions of the bottle towards the push valve (200). The exact slope of the inclined shelf (120) may vary by particular embodiment and the type of product to be dispensed. For example, an embodiment suitable for dispensing viscous liquids and liquid food products, such as ketchup, mustard, nacho cheese, or other products, may reach product extraction rates of 98% or more with the product bottle (300) having a slope of 20 to 40 degrees while an embodiment suitable for dispensing liquid soap or a lower viscosity liquid food product such as syrup may reach product extraction rates of 98% or more with the product bottle (300) having a slope of only 10 degrees. Appropriate degrees for a slope of the product bottle (300) and inclined shelf (120) will be apparent to one of ordinary skill in the art in light of the disclosure herein.

In the present example, the inclined shelf (120) comprises a solid plane of material having a fixed slope. In other versions, the inclined shelf (120) may provide for some adjustability of the slope of the shelf (120). A button, screw, or other fastener of the shelf (120) might allow for the shelf (120) to be loosened and adjusted to any desired position or angle relative to e.g., the product shelf (104) or generally a horizontal plane defined by a base of the product compartment (105). This could allow for varying types of product viscosity and product bottles (300) to be supported by a single product dispensing system (100). In some embodiments of an inclined shelf (120), rather than being a single plane, there may be one or more posts or rests that, when measured across the upper edge of each, result in the desired slope. Other ways in which inclined shelf (120) may be implemented will be apparent to one of ordinary skill in the art in light of the disclosure herein.

Figure 8:
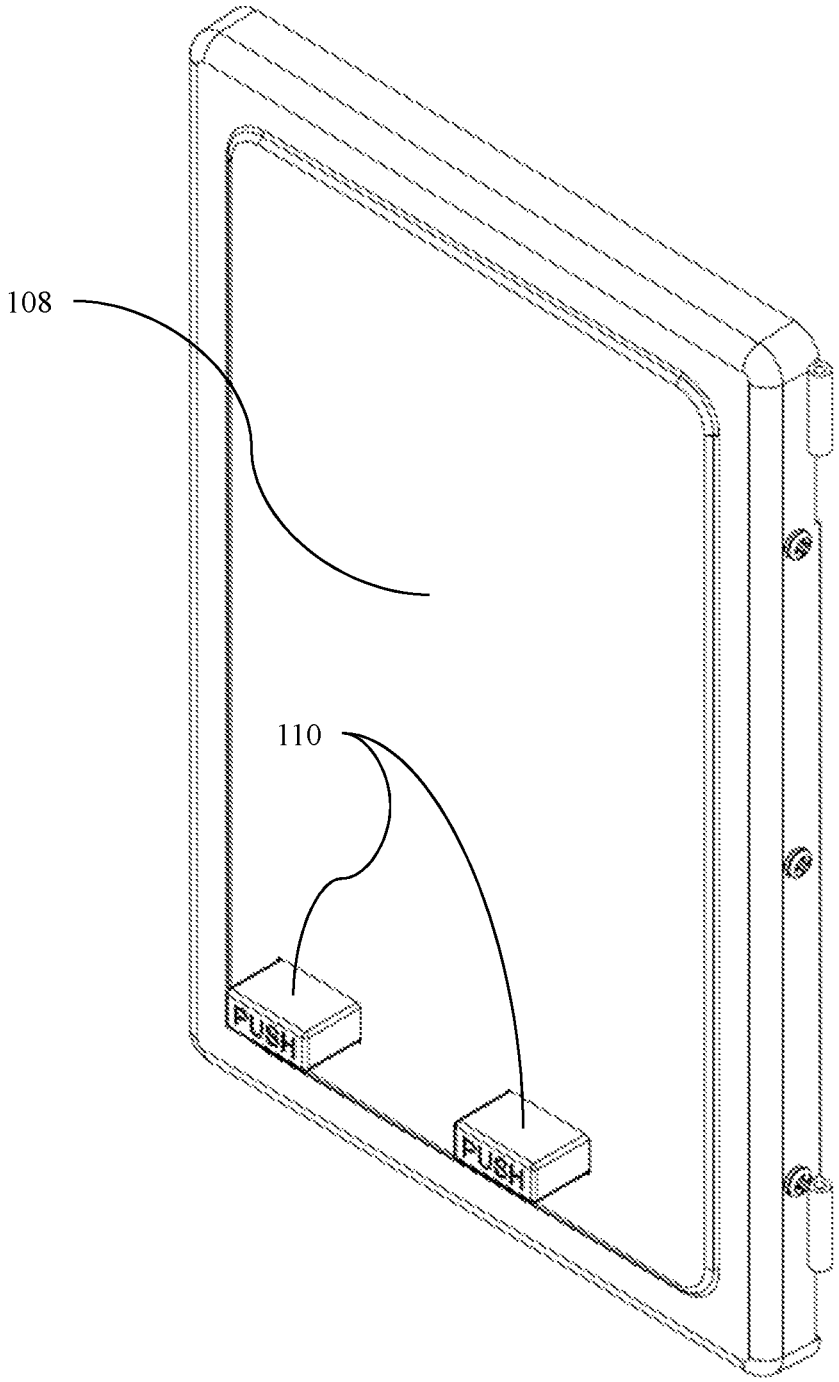
FIG. 8 is a front perspective view of an exemplary door of the product dispensing system of FIG. 1.
Figure 9:
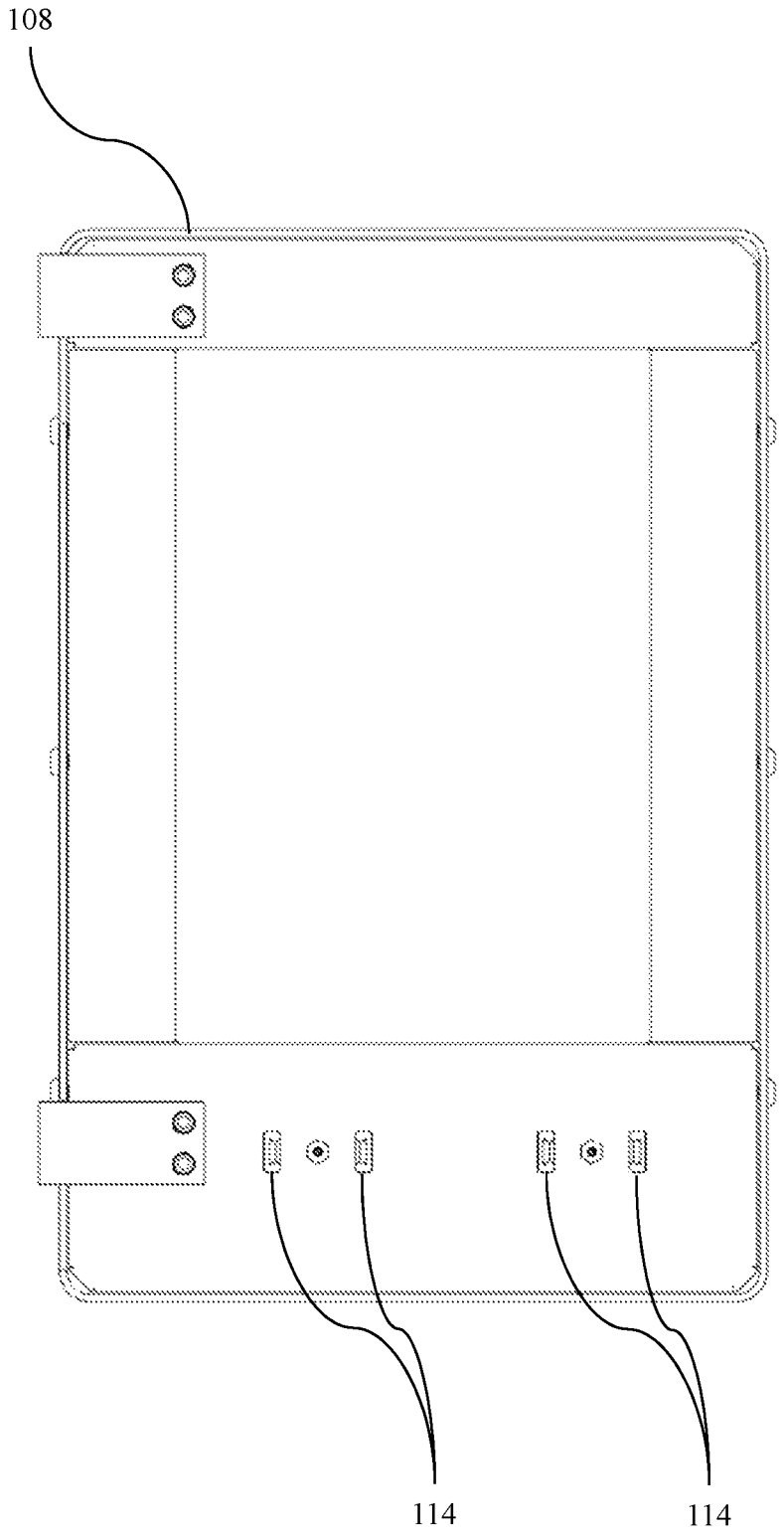
FIG. 9 is a rear elevation view of the door of FIG. 8.
Figure 10:
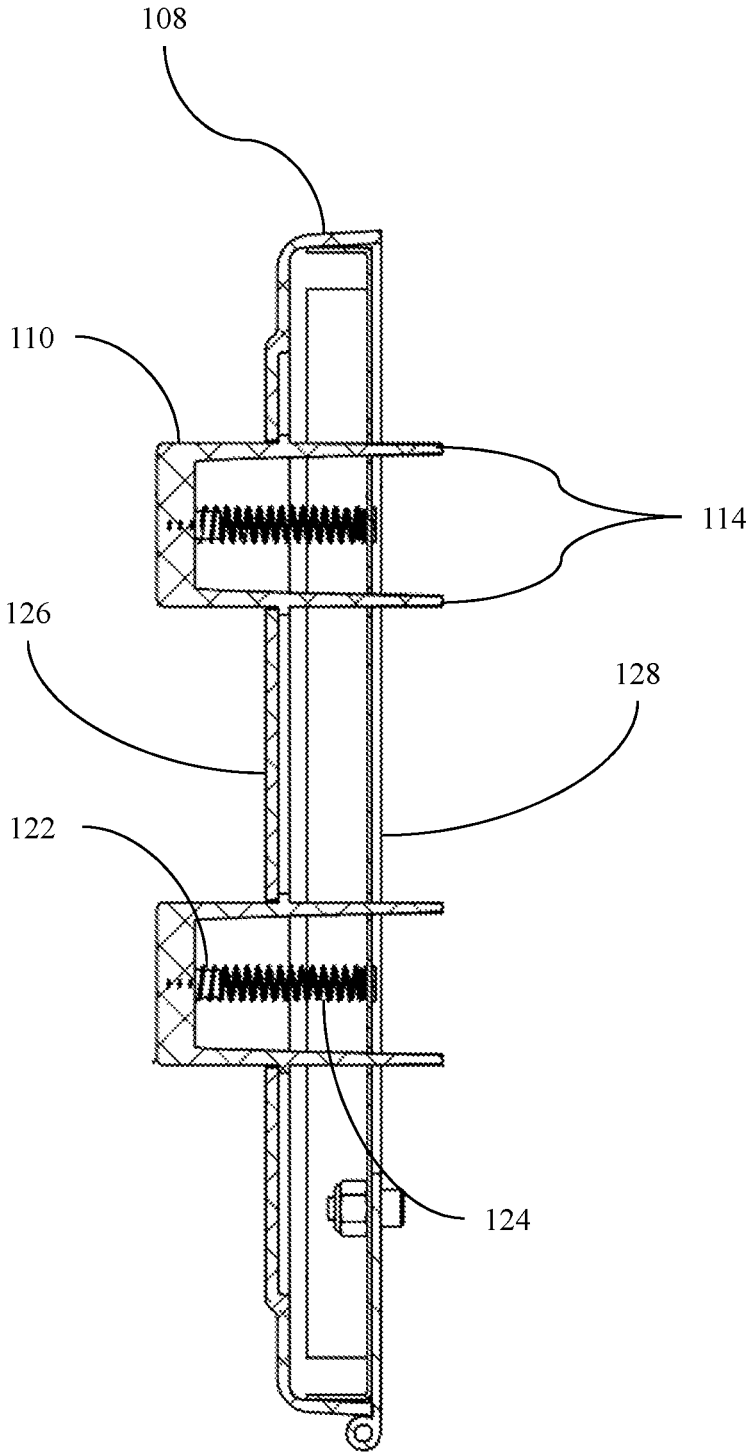
FIG. 10 is an overhead cross-sectional view of the door of FIG. 8.
Figure 11:
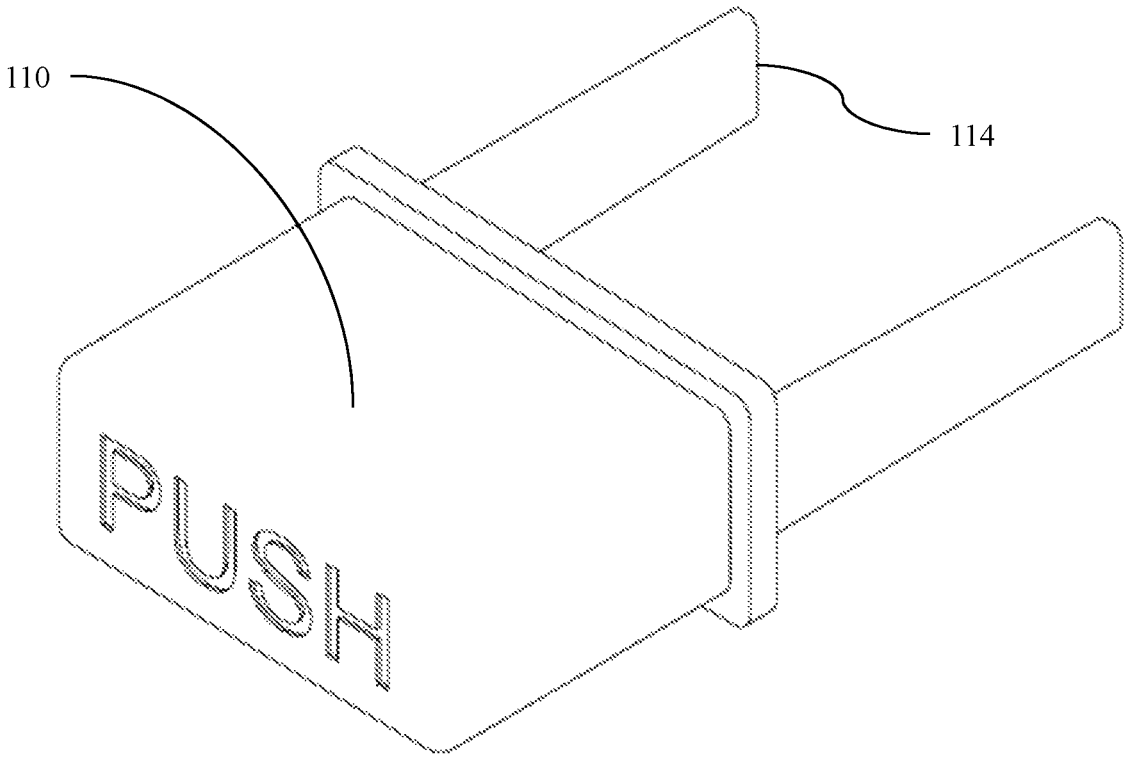
FIG. 11 is a front perspective view of an exemplary button of the product dispensing system of FIG. 1.
Figure 12:
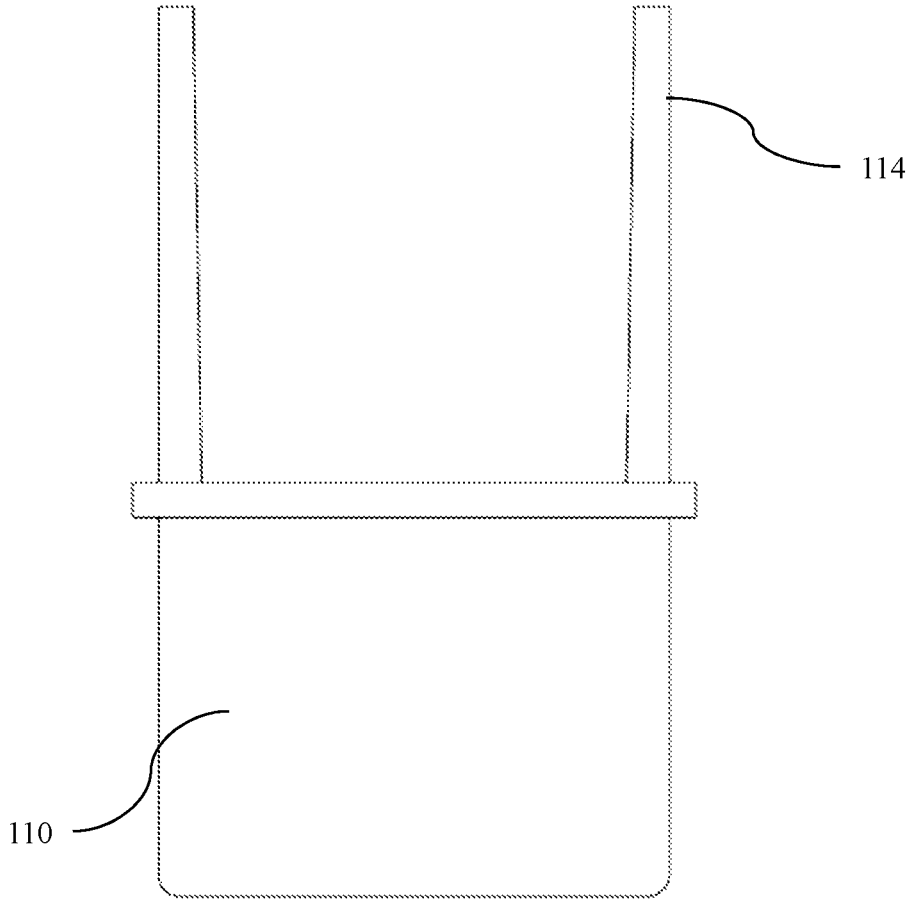
FIG. 12 is an overhead view of the button of FIG. 11.

FIG. 8 is a front perspective view of the door (108) of the exemplary product dispensing system (100), showing the push buttons (110), while FIG. 9 shows the rear of the door (108) and the button arms (114) which extend through the door (108) and out of the rear. FIG. 10 is an overhead cross-sectional view of the door (108), showing the push button (110) in cross section passing through an exterior wall (126) and out an interior wall (128) of the door (108). The push button (110) has a cavity within containing a spring mount (122). The spring mount (122) receives a spring (124), which is mounted between the spring mount (122) and the interior wall (128). When the push button (110) is pushed, the spring (124) flexes, allowing the push button (110) to pass inwards partially through the door (108), and the button arms (114) to extend inwards through the interior wall. When the pressure that is depressing the push button (110) is removed, the spring (124) will expand and push the push button (110) outward back to its neutral position. While the present example illustrates the spring (124), in other versions the spring (124) may be replace by another resilient member or feature, such as a resilient tab or other structure that will be apparent to those of ordinary skill in the art in view of the teachings herein. When the shown door (108) is closed and a product bottle (300) with a push valve (200) is placed in the positioning shelf (116), the push valve (200) will be aligned with the button arms (114) such that it will be pushed, causing an aperture (215) of the push valve (200), formed by a lower aperture (216) and an upper aperture (224), to open, as the button arms (114) extend inward through the interior wall (128). FIGS. 11 and 12 show additional views of the push button (110) and push button arms (114).

Figure 13:
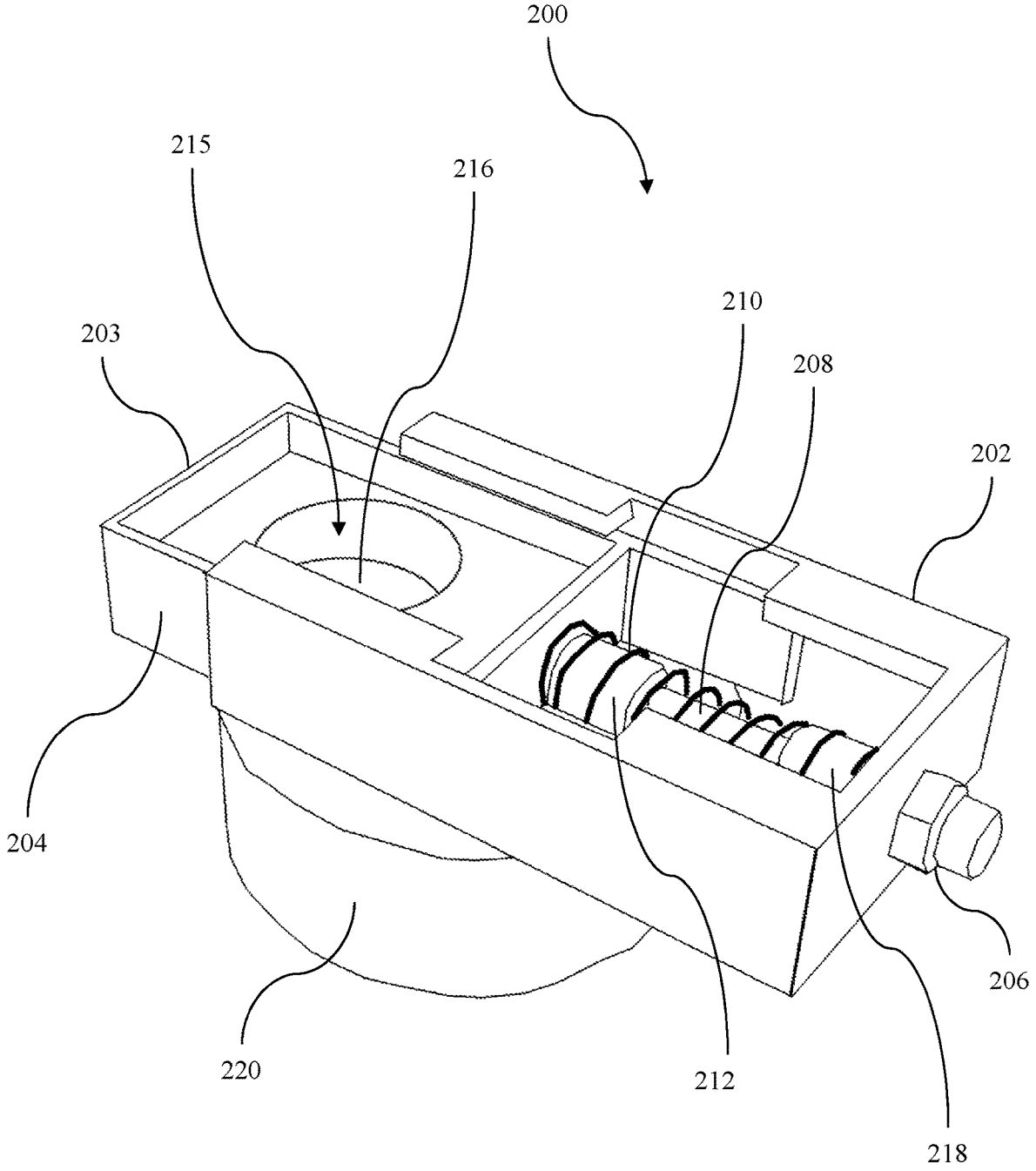
FIG. 13 is a front perspective view of an exemplary push valve of the product dispensing system of FIG. 1.

FIG. 13 is a front perspective view of the exemplary push valve (200). The push valve comprises an upper frame (202) and a lower frame (204). The lower frame (204) fits within the upper frame (202). A slide (208), which may be a screw or rod for example, attaches to the lower frame (204) at a spring mount (212). A spring (210) fits over the slide and is held in place at each end by the spring mount (212) of the lower frame (204) and a spring mount (218) of the upper frame (202). The slide (208) passes through the spring mount (218) of the upper frame (202) and is held in place by a fastener (206). Assembled in this manner, a push surface (203) of the push valve (200) can be pressed, causing the lower frame (204) to slide within the upper frame (202), which compresses the spring (210) and causes the slide (208) to extend outward through the spring mount (218) of the upper frame (202). When the pressing force is removed, the spring (210) will push the lower frame (204) back to its neutral position shown in FIG. 13. In some embodiments, the slide (208) may be a threaded screw which screws into a threaded spring mount (212) of the lower frame (204), but which rests freely within the smooth spring mount (218) of the upper frame (202), and is held in place by a nut fastener (206) at that end. The upper frame (202) and lower frame (204) of the push valve (200) may be constructed of plastic, metal, or other appropriate materials, and may be designed to be disposable or re-usable as may be desirable for a particular use.

Figure 14:
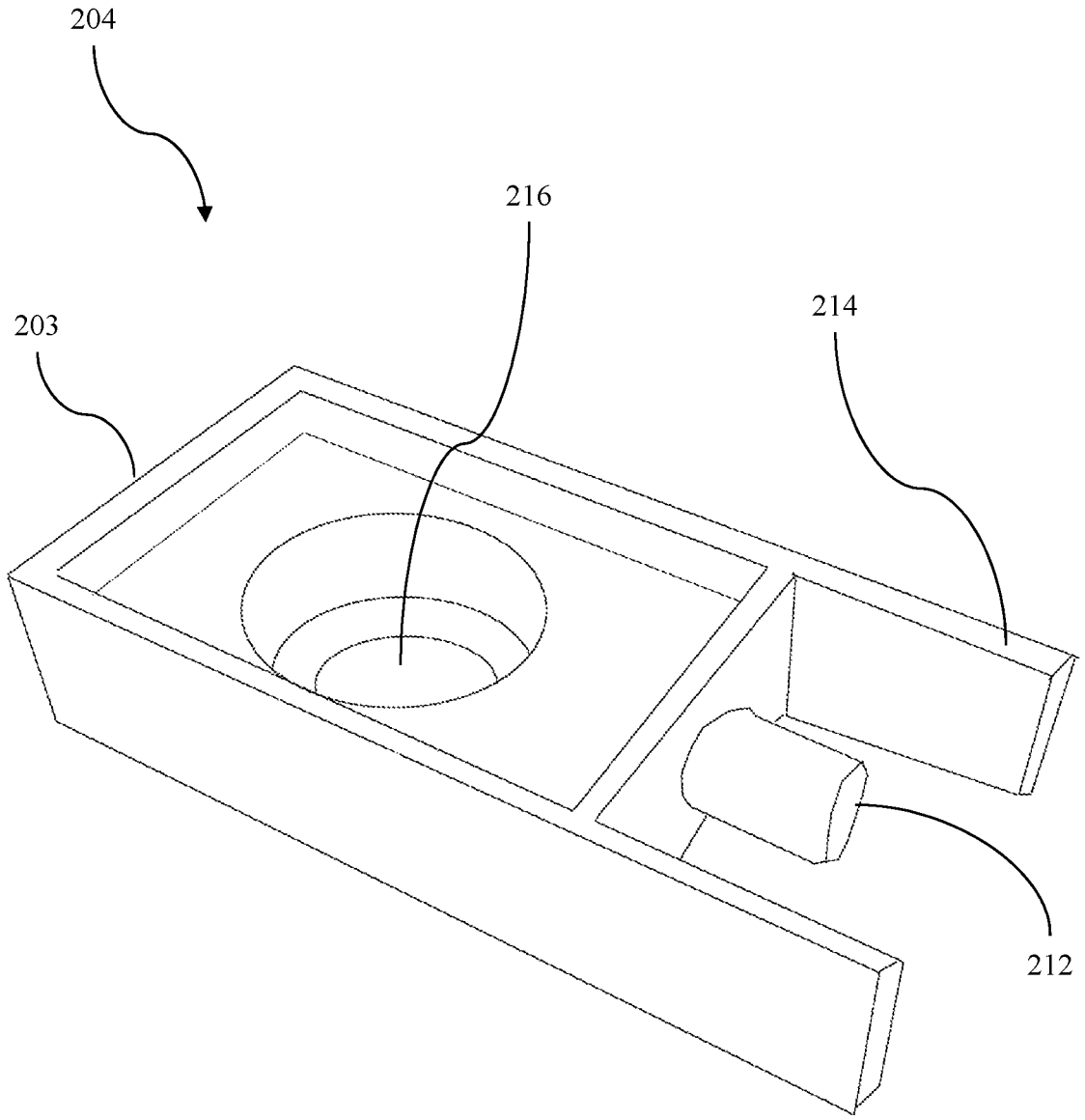
FIG. 14 is a front perspective view of a bottom portion of the push valve of FIG. 13.

Also shown in FIG. 13 is a lower aperture (216) of the lower frame (204). The lower aperture (216) passes through the lower frame (204) and may be of varying diameter, with smaller diameters reducing the flow of product through the lower aperture (216) and larger diameters increasing the flow of product through the lower aperture (216). In the neutral or closed position of the push valve (200) shown in FIG. 13, the lower aperture (216) is fully blocked by the bottle mount (220) of the upper frame (202) preventing the flow of product through the lower aperture (216). FIG. 14 is a front perspective view of the lower frame (204) of the exemplary push valve (200). The arms (214) of the push valve (200) can be more clearly seen in this view. The arms (214) fit within a groove (222) of the upper frame (202), shown in FIG. 15, and allow the lower frame (204) to slide freely in and out of the groove (222) longitudinally, while fitting snugly enough to reduce movements orthogonally (e.g., side to side, up and down).

Figure 15:
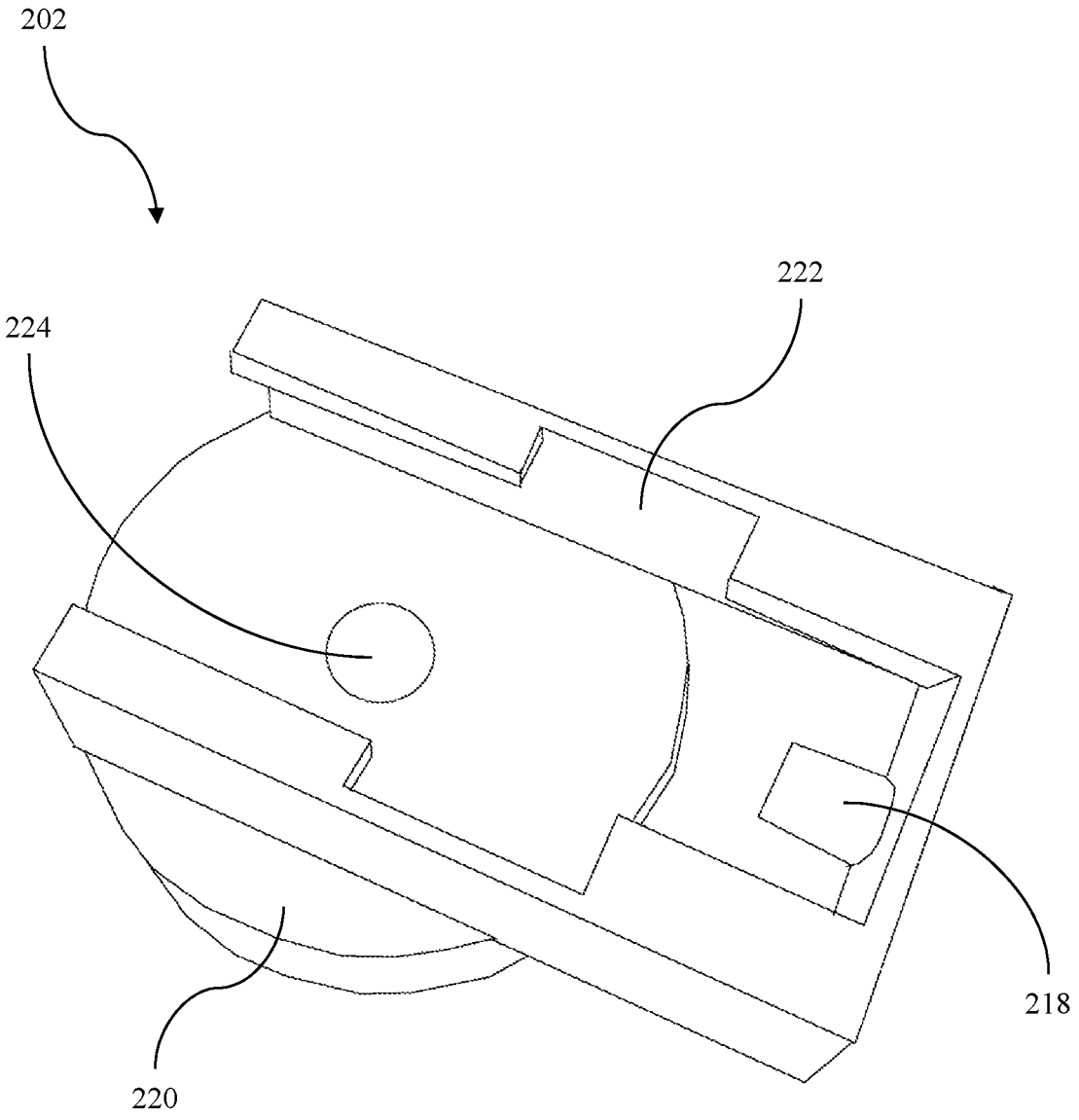
FIG. 15 is a front perspective view of a top portion of the push valve of FIG. 13.

FIG. 15 further shows a bottle mount (220) of the upper frame (202). The bottle mount (220) is sized and shaped to fit the spout (303) of a product bottle (300), and may have a threaded (226) interior to allow it to be screwed to a threaded spout (303) of a product bottle (300). In this manner, a storage cap of the product bottle (300) may be unscrewed and removed, and the push valve (200) may be screwed directly onto the spout (303) of the product bottle (300). While the shown embodiment uses a circular bottle mount (220) configured to be threaded onto the product bottle (300), other types of mount exist and will be apparent to one of ordinary skill in the art in light of the disclosure herein. For instance, various quick-connect features, or other modes of connection, may be incorporated into the spouts and bottle mount (220) in some other versions.

Figure 16:
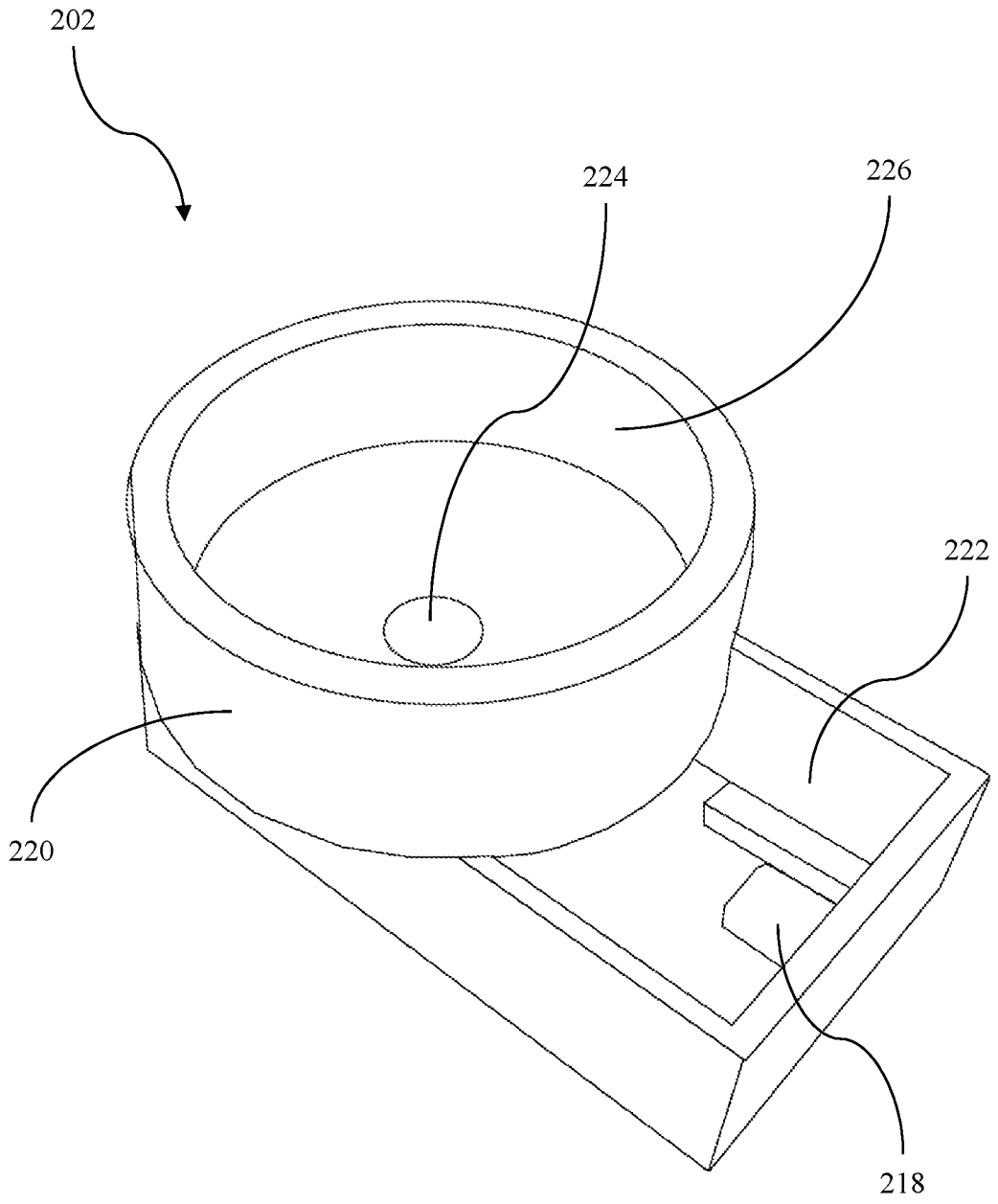
FIG. 16 is a bottom perspective view of a top portion of the push valve of FIG. 13.

FIGS. 15 and 16 each show an upper aperture (224) that aligns with the space defined by the sidewalls of the upper frame (202), and is arranged to be underneath the spout (303) of a product bottle (300) when the push valve (200) is attached to the product bottle (300) by way of the bottle mount (220). In the neutral or closed position shown in FIG. 13, the upper aperture (224) is blocked by the lower frame (204). As with the lower aperture (216), the size and characteristics of the upper aperture (224) may be varied to accommodate different types of product and different desired product flow rates. When the upper aperture (224) and lower aperture (216) are aligned over top of each other the result is a direct flow path for product to flow from the product bottle (300), into the bottle mount (220), through the portions of the upper (224) and lower (216) apertures that align, and towards the product shelf (104).

As can be seen in FIGS. 13-16, the size of the flow path will depend upon both the size and the positions of the upper (224) and lower (216) aperture relative to each other. The maximum flow will occur when the apertures (216, 224) are aligned directly over top of each other, in other words when apertures (216, 224) are concentrically aligned. As the apertures become more offset, the flow or volume of flow is reduced and then eventually closed entirely when the apertures (216, 224) do not overlap. In this manner, as the push valve (200) is pushed inwards, the lower aperture (216) will move towards and eventually begin to overlap with the upper aperture (224) creating a minimal flow. The flow will continue to increase in size as the lower frame (204) continues to be pushed inwards until the maximum flow is reached when the apertures (216, 224) are directly aligned. Then, as the pressing force is removed, the lower frame (204) will return to its neutral position, decreasing the flow and eventually closing the valve entirely when the apertures (216, 224) no longer overlap.

Figure 17:
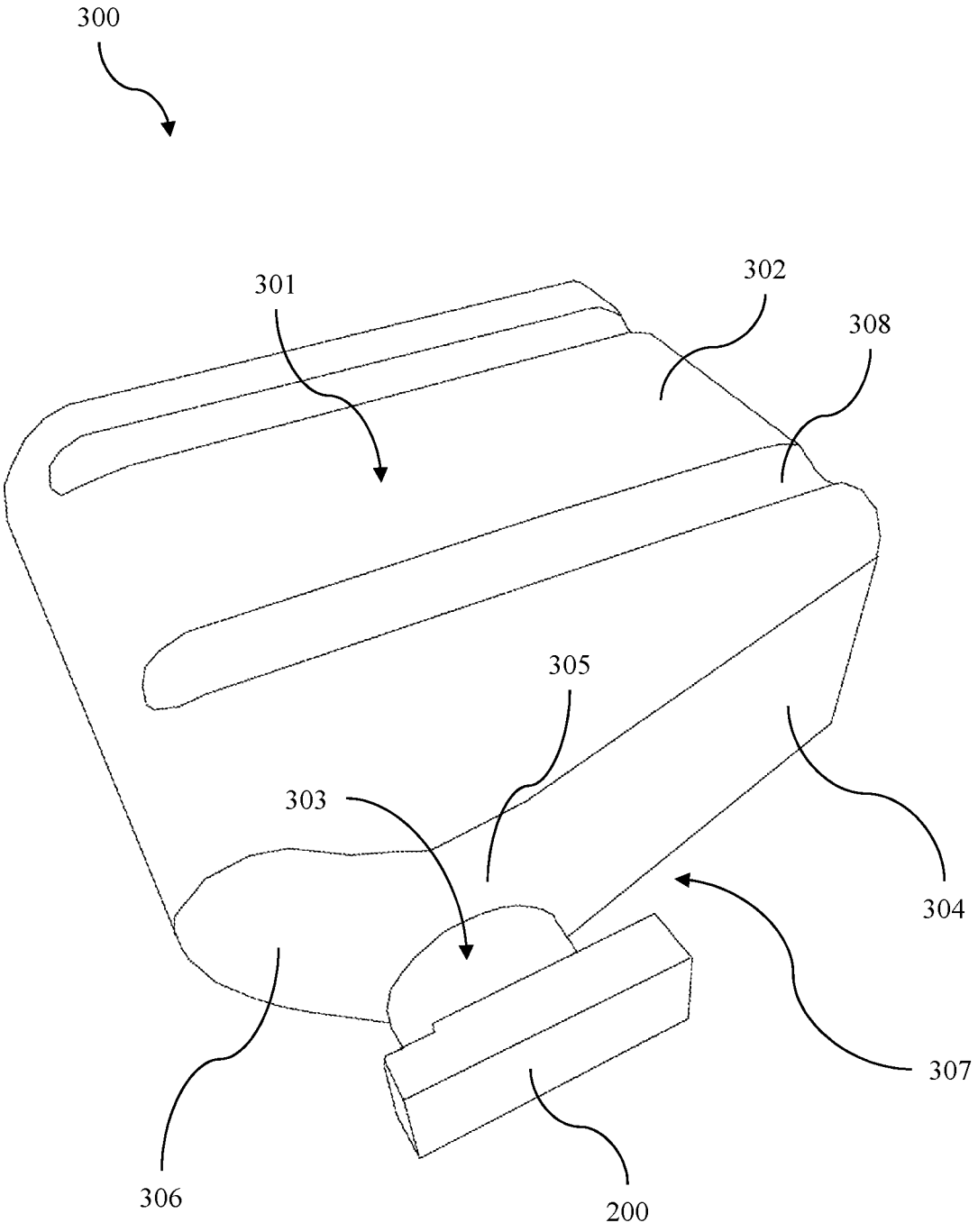
FIG. 17 is a bottom perspective view of an exemplary product bottle usable with the product dispensing system of FIG. 1.

FIG. 17 is a bottom perspective view of the exemplary product bottle (300) containing product (301) with the push valve (200) attached. The product bottle (300) may be made of plastic, metal, or other appropriate materials depending upon factors such as desired cost, type of product stored therein, and location and type of use. In some embodiments, the product bottle (300) will be made of semi-rigid plastic, which may be advantageous in striking a balance between cost of materials and construction and durability, as a semi-rigid bottle can be tear and puncture resistant which is helpful for shipment, storage and installation. The walls (302) can be made thin so that weight and production cost is reduced, but should still be thick enough to provide some puncture and tear protection. The above described characteristics and other characteristics of the bottle may be adjusted as needed to allow for a variety of products to be stored and dispensed from a product bottle (300). This could include, for example, food products of various types and consistencies, high acid food products, hot fill food products, cleaning products, caustic products, solvents, and other products. Ridges or grooves (308) may be placed in the side walls (302) of the product bottle (300) to increase rigidity of the overall container (300). Such ridges or grooves (308) may also be designed and placed in order to aid in installation, for example, where a ridge (308) lines up with a rail or retaining bar in a product dispensing system (100), such that the ridge (308) rests upon the rail and provides a guide for placing the product bottle (300) in addition to providing additional stability when installed.

A lower wall (307) of the bottle (300) comprises a first portion (304) having a first slope, and a second portion (306) having a second slope. The first portion (304) starts towards the rear of the bottle (300) and slopes downward towards the spout (303) and attached push valve (200). As discussed earlier, the first portion (304) will generally match the slope of the inclined shelf (120) and may be varied similarly and for similar reasons. The first portion (304) serves several functions, including that, when installed, it provides a downward slope that allows gravity to naturally feed product (301) towards the spout (303) and attached push valve (200), and to rest upon the inclined shelf (120) and provide stability. The product bottle (300) has a second portion (306) located closer to the front of the bottle (300), which slopes downward towards the spout (303) and attached push valve (200). The second portion (306) and the first portion (304) generally meet above the spout (303) and attached push valve (200). The second portion (306) similarly serves several functions like the first portion (304), including that the second portion (306) provides a downward slope towards the attached push valve (200) that allows for gravity to naturally feed product, and that it is shaped and contoured to fit the valve notch (117) of the positioning shelf (116) so that, when installed, the combination of the positioning shelf (116) and the inclined shelf (120) provide a stable installation position that, by default, places the push valve (200) in a position that the push surface (203) will be contacted by the button arms (114) of the push button (110) when pushed.

Figure 18:
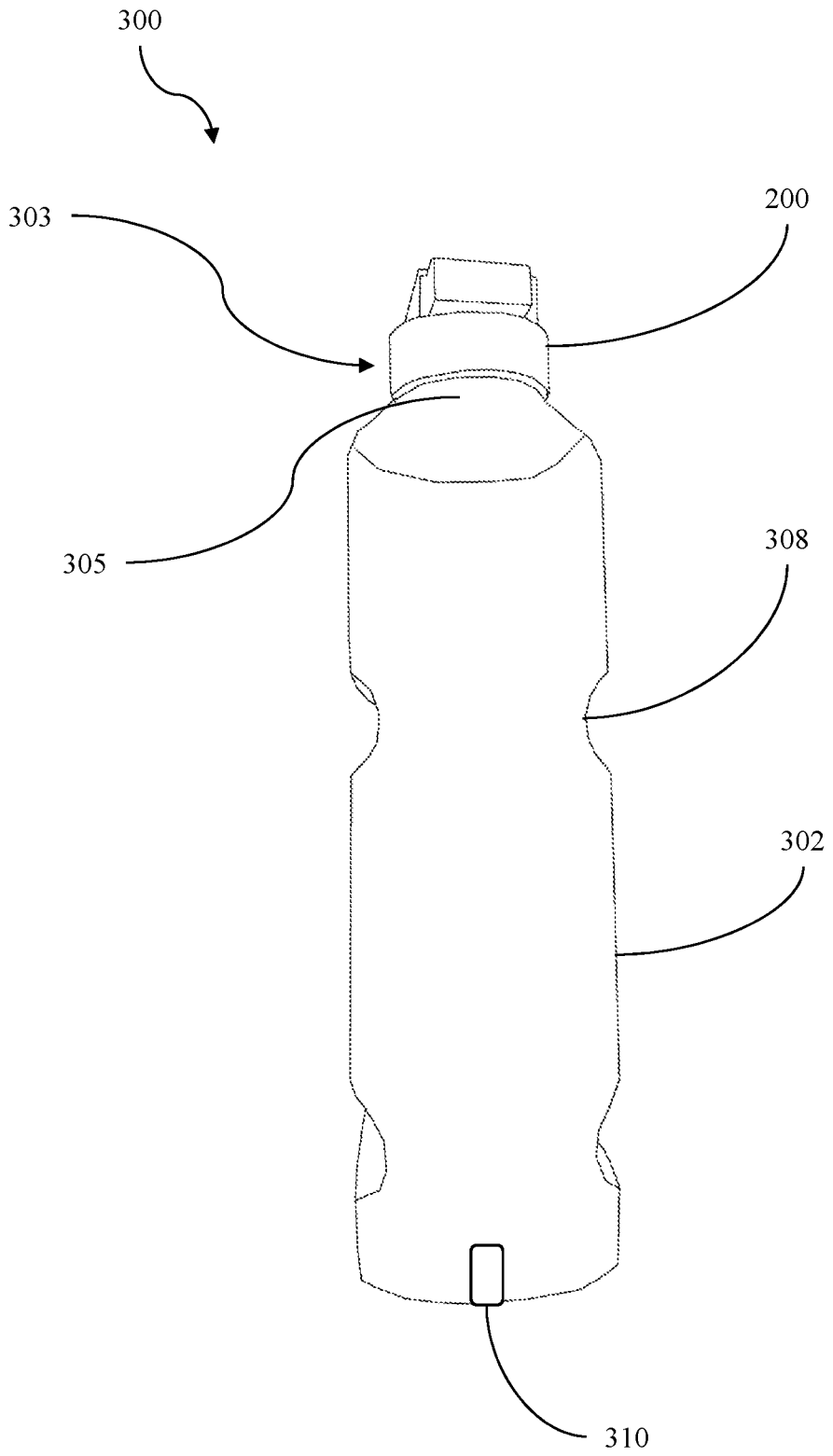
FIG. 18 is a side elevation view of the product bottle of FIG. 17.

FIG. 18 is a side elevation view of the exemplary product bottle (300) that additionally shows an exemplary tab (310) that may be present in some embodiments. The tab (310) may be pulled, cut, twisted, or otherwise pierced or removed to prevent a vacuum from building within the product bottle (300) as product is dispensed. Other features that would prevent a vacuum buildup will be apparent to one of ordinary skill in the art in light of this disclosure. For example, the pressure release mechanism may be a valve or other opening having a removable induction seal, a removable screw cap, or both, and may be positioned so that when the valve is open it releases pressure within the bottle but does not allow the contents of the bottle to leak. Preventing a vacuum by providing this venting feature will allow for more consistent and predictable dispensing of product (301) when the push valve (200) is depressed. In some embodiments, the tab (310) may be integrated with a filter or unidirectional flow in order to minimize or prevent incidental contamination of the product bottle (300).

The above described product dispensing system (100), push valve (200), and product bottle (300) provide numerous advantages over conventional systems. As has been previously described, characteristics of the system may be modified based upon the teachings herein in order to make the system appropriate for dispensing of a variety of products including liquids, viscous liquids, mixes of solids and liquids, and combinations thereof, and may also include high and low acid food products or various types, or non-food products of various types. The disclosed system does not require any active pump mechanism or mechanical press system, and may rely entirely on gravity to feed product while still achieving product extraction rates superior to bag based systems that require one or more active pumping systems or press systems for extracting and dispensing product. Of course, in some versions, the product dispensing system (100) may be modified to work with one or more active systems or press systems such as a pump, weight, spring loaded press, or other device.

In some embodiments, the disclosed system may not require a power source for heating or dispensing at all, such as where, for example, the product dispensed is high acid or not a food product. Such a system could be advantageously used in settings where electricity is not easily available, such as festivals or fairs that may have temporary installation of dispensing systems. Despite the lack of reliance on active pumping systems for extraction, the gravity fed system disclosed herein allows for very high extraction rates of product, for example, 98% or even higher, as compared to bag systems. Conventional dispensing systems with active pumps may aim to achieve extraction rates of approximately 90%, while conventional systems with press systems aim to achieve extraction rates of approximately 85%, but each may require additional steps such as a system operator manually massaging, manipulating, or moving product from corners of the bag towards the valve to aid in extraction and reach those goals. However, in practice, when a bag system begins to dispense product unevenly, the bag is often just replaced rather than being manually massaged or manipulated to move product towards the valve, so actual extraction rates may be much lower.

The disclosed system also provides advantages and improvements related to installation of product. Installation of a product bottle (300) having rigid or semi-rigid sides may be less burdensome than installation of a flexible bag having no real structure, especially for situations where an installer has limited upper body strength or is installing into a position that is above their waist level. Chance of tearing, ripping, or otherwise damaging the product container is reduced or eliminated as well, as the product bottle (300) will behave predictably during installation rather than folding and deforming as a bag might so as to potentially catch or snag on objects within the dispenser that might be puncture risks. Installation of the product bottle (300) is also simpler in that features such as the inclined shelf (120) and positioning shelf (116) guide and enforce proper position within the product compartment (105) such that if the product bottle (300) is placed, it is necessarily in the proper position for operation. This is not the case with bag products, which often require that a valve or nozzle on the bag be within a certain area of a mostly empty cuboidal product compartment so that a hose or pump can be attached, or so that a weight or press mechanism may be positioned on the bag. If the bag is placed upside down, or with the nozzle facing to the rear of the compartment, the bag may need to be removed and replaced in a differing orientation so that the hose length allows for connection with the pump, or so that there is room to place a weight or press.

To further illustrate some of the advantages of the disclosed system, installation steps for a conventional system might include opening a box of product, removing a bag from the box, attaching a valve to the bag, determining the proper position and orientation of the bag within the compartment based upon factors such as pump location and hose length, placing the bag in the compartment, ensuring that the door or cover can close and manipulating the bag if necessary, placing a weight or press mechanism to be in contact with the bag if provided, attaching a hose to the valve, feeding the hose into or through a pump mechanism if provided, and closing the cover or door. In comparison, installation steps for the disclosed system might in some embodiments include attaching a push valve (200) to the product bottle (300), opening the tab (310), placing the product bottle (300) against the inclined shelf (120) and on the positioning shelf (116), and closing the door (108). While the disclosed system does not require active systems such as pumps in order to achieve the discussed extraction rates, it should be understood that versions of the disclosed system that do include active systems such as pumps, or mechanical press systems are also contemplated by this disclosure.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A dispensing system comprising:

(a) a bottle comprising a spout positioned at the lowest point of the bottle, a body positioned above the spout along a vertical axis, and an angled surface extending from the rear of the bottle downwards to the spout, wherein the angled surface is a majority of the area of a bottom of the bottle, and wherein the bottle contains a viscous food product;

(b) a case comprising an interior containing an inclined shelf and a positioning shelf, wherein:

(i) the positioning shelf comprises an aperture having a shape complementary to a shape of the spout such that the aperture guides the bottle into a dispensing position when the spout is placed in the positioning shelf, and (ii) the inclined shelf is adapted to support the angled surface and hold the bottle upright along the vertical axis when the bottle is in the dispensing position; and (c) a valve coupled to the spout and operable to form a dispensing aperture along the horizontal axis through which the food product can flow from the valve along the vertical axis, wherein the dispensing aperture is proximate to and directly below an aperture of the spout;

wherein the bottle is formed of a semi-rigid material capable of substantially maintaining the bottle's initial shape when filled with the food product and positioned at the dispensing position.

2. The dispensing system of claim 1, wherein a slope of the inclined shelf is complementary to a slope of the angled surface of the bottle such that the angled surface rests evenly against the inclined shelf when the bottle is in the dispensing position.

3. The dispensing system of claim 1, wherein the interior further contains a second inclined shelf and a second positioning shelf, wherein second positioning shelf is adapted to position a second bottle at a second dispensing position within the interior that is adjacent to the dispensing position.

4. The dispensing system of claim 1, wherein the positioning shelf and the inclined shelf are the only structures supporting the bottle when it is placed at the dispensing position.

5. The dispensing system of claim 1, the case further comprising a heating element operable to heat the inclined shelf, wherein the inclined shelf is adapted to contact a majority of the angled surface when the bottle is placed is placed at the dispensing position.

6. The dispensing system of claim 1, wherein a slope of the angled surface is adapted to provide at least a 98% extraction rate of the food product in the bottle.

7. The dispensing system of claim 6, wherein the slope of the second surface is between about 20 to about 40 degrees.

8. The dispensing system of claim 1, wherein the valve consists essentially of:

(i) an upper frame having a threaded connector coupled to the spout, (ii) a lower frame coupled to the upper frame and movable along the horizontal axis when depressed, and (iii) a biased connector adapted to cause the lower frame to return to an origin position from a depressed position.

9. The dispensing system of claim 8, further comprising a cover enclosing the case, wherein the cover comprises a push button that may be pushed into the interior along the horizontal axis to move the lower frame to the depressed position and form the dispensing aperture.

10. The dispensing system of claim 1, wherein the bottle comprises a vent at the highest point of the bottle.

11. The dispensing system of claim 1, wherein gravity provides the majority of extraction force to cause the viscous food product to flow through the dispensing aperture along the vertical axis.

12. The dispensing system of claim 1, wherein the case comprises a dispensing shelf positioned directly below and along a shared axis with the aperture of the spout and the dispensing aperture of the valve.

13. The dispensing system of claim 1, wherein:

(i) the valve is enclosed within the interior of the case, and (ii) the case comprises an opening positioned directly below and along a shared axis with the aperture of the spout and the dispensing aperture of the valve.

14. A bottle for use with a food dispensing system, the bottle comprising:

(a) a spout positioned on a bottom of the bottle and comprising an aperture along a horizontal axis;

(b) a body positioned along a vertical axis above the spout;

(c) an angled surface extending from a rear of the bottle downwards to the spout, wherein the angled surface is adapted to hold the bottle upright along the vertical axis when the bottle is placed within a dispensing case;

(d) a valve coupled to the spout, the valve comprising an upper frame and a lower frame, the upper frame comprising an upper aperture and the lower frame comprising a lower aperture, wherein:

(i) the upper frame and the lower frame are coupled so that the lower frame can slide along the upper frame parallel to the horizontal axis between a neutral position and a depressed position, and (ii) when the lower frame is in the depressed position, the lower aperture is positioned below the upper aperture and a dispensing aperture is formed, directly below the aperture of the spout and parallel to the horizontal axis, through which a product can flow from the valve along the vertical axis;

wherein the bottle is formed of a semi-rigid material capable of substantially maintaining the bottle's initial shape when filled with the food product and positioned at the dispensing position.

15. The bottle of claim 14, wherein a slope of the angled surface is adapted to be complementary to the slope of an installation surface of the dispensing case such that a majority of the angled surface contacts the installation surface when the bottle is installed within the dispensing case.

16. The bottle of claim 14, wherein the spout is shaped to position the bottle in a dispensing position that is determined by a positioning shelf within the dispensing case.

17. The bottle of claim 14, wherein the upper frame and the lower frame are coupled by a biased connector, and wherein the biased connector is adapted to cause the lower frame to return to the neutral position.

18. The valve of claim 17, wherein the valve consists essentially of the lower frame, the upper frame, and the biased connector.

* * * * *